United States Patent [19]

Ryckman, Jr.

[11] 4,163,963

[45] Aug. 7, 1979

[54] PROBE CONTROL

[75] Inventor: William D. Ryckman, Jr., Asheboro, N.C.

[73] Assignee: General Electric Company, New York, N.Y.

[21] Appl. No.: 831,608

[22] Filed: Sep. 8, 1977

[51] Int. Cl.[2] ..... H01C 7/04

[52] U.S. Cl. ..... 338/28; 338/22 R

[58] Field of Search ..... 338/22 R, 225 D, 23, 338/25, 28, 229; 73/362 AR, 343 B, 343 R; 99/325, 331, 334; 219/441, 386, 385, 533, 436, 438, 449, 442

[56] References Cited

U.S. PATENT DOCUMENTS

| | | | |
|---|---|---|---|
| 2,830,166 | 4/1958 | Loomis | 99/331 X |
| 3,095,498 | 6/1963 | Foster | 99/331 X |
| 3,218,434 | 11/1965 | Lee et al. | 219/385 |
| 3,295,373 | 1/1967 | Boddy | 338/28 X |
| 3,440,405 | 4/1969 | Fowler | 219/441 |

*Primary Examiner*—C. L. Albritton

*Attorney, Agent, or Firm*—John F. Cullen; George R. Powers; Leonard J. Platt

[57] ABSTRACT

The invention is a detachable probe control for an electrically heated utensil to sense the temperature and control the electric current to the utensil. It uses a hollow thin walled tubular finger that snugly fits in a matching recess for good heat conduction therebetween for temperature control of the utensil in a conventional manner. The particular probe of the invention uses a transducer in the form of a thermistor that is supported in the finger of a unique mounting such that the temperature of the tube walls is readily sensed by the thermistor. Structure is provided to electrically insulate the thermistor while at the same time permitting thermal conductivity to the thermistor whereby the thermistor responds rapidly to finger or probe temperature changes for accurate temperature control of the utensil.

7 Claims, 5 Drawing Figures

PROBE CONTROL

BACKGROUND OF THE INVENTION

1. Field of the Invention

The invention pertains to a detachable probe control for sensing electric utensil temperatures electronically by means of a thermistor resulting in rapid sensing of temperature changes and very accurate utensil heat control.

2. Description of the Prior Art

Electronic temperature control circuits employing thermistors have been in wide use for a number of years. A thermistor is defined as a solid state semi-conducting device having an electrical resistance which varies with the temperature. Its temperature coefficient of resistance is high, non-linear, and most commonly negative. The use of electronic temperature control for utensils has not become accepted practice, however, largely due to the lack of a suitable method of mating the sensing element portion of the electronic circuit to the utensil in such a manner that assures satisfactory thermal contact and does not interfere with generally accepted use patterns established for the electric utensil such as electric skillets. An almost universal feature on currently available electric skillets is a detachable combination power supply and thermostatic probe control unit that can be removed from the skillet as necessary for storage or cleaning purposes. The present invention offers a solution to the problem in that the sensing probe provides means for placing the thermistor in adequate thermal contact with the heated skillet surface while at the same time adequately electrically isolating it and using it in the standard-type probe so that it is readily detachable and adaptable to applications that use the standard probe design typical of the type shown in U.S. Pat. No. 3,737,623 of common assignment. The present invention is an improvement on the standard probe in using a thermistor heat sensing element and a unique supporting structure for the thermistor within a probe finger for electrically insulating it as necessary while providing good thermal conductive means to it for sensing temperature.

SUMMARY OF THE INVENTION

In accordance with the invention, a detachable probe control is provided for an electrically heated utensil that uses an electronic heat sensing member such as a thermistor in the probe. The probe consists of a hollow tubular finger snugly fitting a matching recess in the utensil for good heat conduction therebetween to provide temperature control of the utensil in a standard manner. In this structure there is provided a thermistor sensing means that is supported within the probe finger by a pair of separate complementary half arcuate and electrically conductive clamps that are oppositely disposed within the finger and outwardly biased against an electrical paper insulating sleeve between the clamps and hollow finger for good thermal conductivity only through the sleeve. The sleeve insulates the clamps from each other and from the finger. The clamps are designed with overlapping tabs for supporting a thermistor therebetween with each clamp forming a terminal for the thermistor and means connects each clamp with a current control for rapid response to temperature changes for accurate heat control of the utensil. The clips are designed to be excellent conductors of heat but have a low heat capacity due to their small mass. Thus, temperature changes of the tubular finger are quickly sensed by the thermistor which relays this information to control circuitry to adjust the temperature of the utensil. Additionally, the tubular finger has a longitudinal slot cut in such manner that two sections are formed which can be spread slightly apart to insure a snug fit between the finger and the internal surfaces of the utensil recess for intimate thermal contact for sensing temperature of the cooking surface of the utensil. Thus, the main object of the invention is to provide a detachable electronic temperature sensing probe using a thermistor that can be used with a conventional electrically heated utensil.

BRIEF DESCRIPTION OF THE DRAWING

Referring to FIG. 1, there is shown a detachable probe of a generally known type, modified in accordance with the invention, for controlling the temperature of an electrically heated utensil. For purposes of description, the utensil will be described as an electric skillet. Such a detachable probe uses a hollow tubular finger 10 that is designed to snugly fit in a matching recess in the skillet for good heat conduction therebetween for thermostatic control of the temperature of the skillet. Electric current is provided by mating the male prongs on the skillet with openings 12 in the control and the temperature is set by knob 14. Such a detachable combination power supply and temperature probe control unit that enables the user to remove it from the skillet for storage or cleaning is well known. One of the difficulties with standard detachable probe controls is they are unable to sense temperature changes quickly enough and adjust to provide a good simmer for cooking. Present day structures "hunt" around the simmer temperature but are unable to hold the temperature on simmer for adequate control. The advent of the electronic control permits this fine tuning providing the electronic unit, such as a thermistor, can be satisfactorily mounted within the standard finger for use. To this end, the invention provides an improvement using a transducer in the form of a thermistor 16 which is able to track very closely the temperature of the skillet. The thermistor must be electrically insulated from any exposed metal parts while receiving the heat by conduction. To utilize the thermistor, the hollow tubular finger 10 is a thin walled stainless steel tube of the same overall dimensions as the mechanical thermostat finger probe used on conventional skillet controls. To enhance the snug fit in the skillet recess, a longitudinal slot may be cut in the tube except for a small portion at the end of the tube and then a portion 20 is bent out of the peripheral surface slightly so that a tight biasing fit between the finger 10 is provided against the walls of the recess for good heat conduction.

Figure 3:
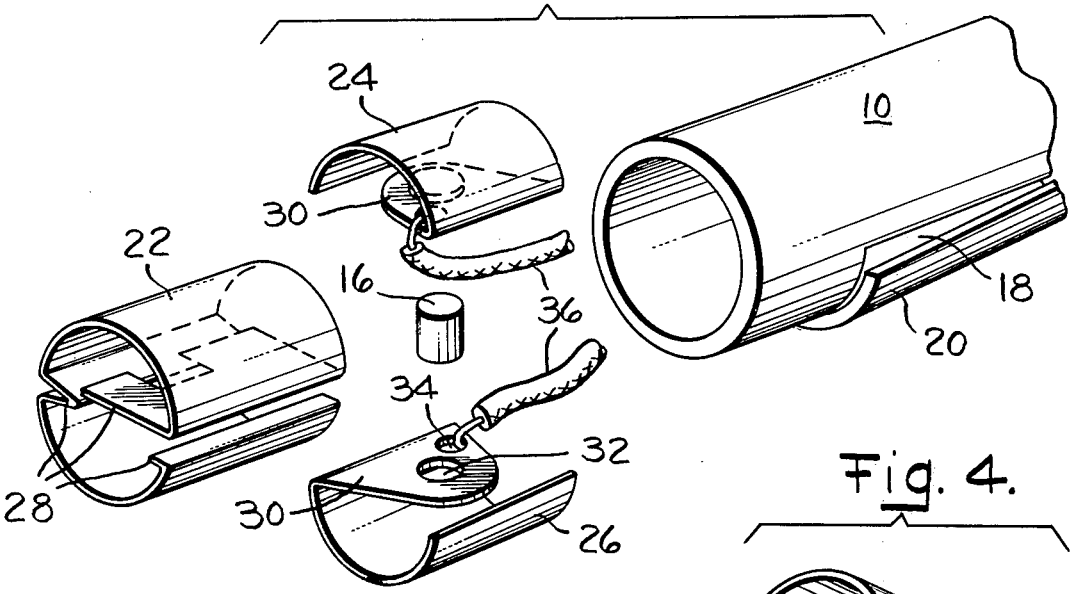
FIG. 3 is an exploded perspective of the thermistor clamp supporting structure.

For mounting the thermistor chip or pellet 16 inside the finger 10, a suitable formed electrical insulator such as paper sleeve 22 as better shown in FIG. 3 is provided.

Figure 1:
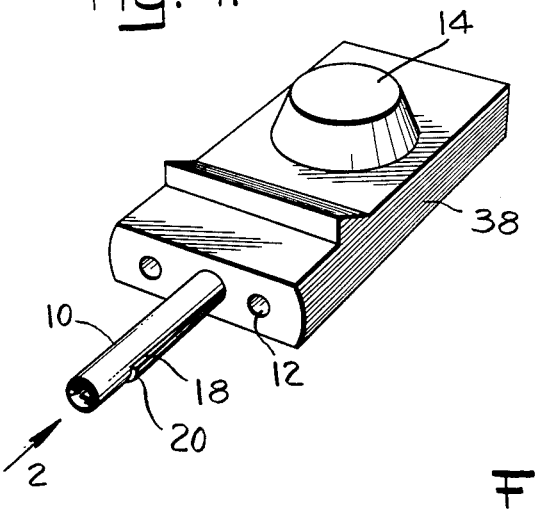
FIG. 1 is a perspective view of a typical probe control.
Figure 2:
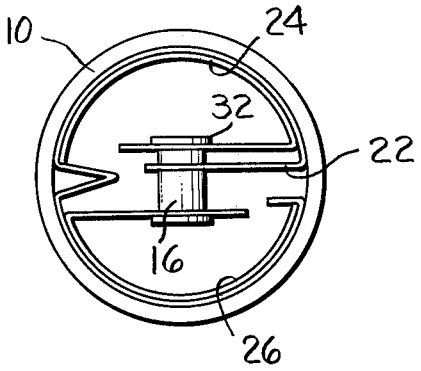
FIG. 2 is a sectional view taken in the direction of arrow 2 on FIG. 1 enlarged to show thermistor supporting structure.
Figure 5:
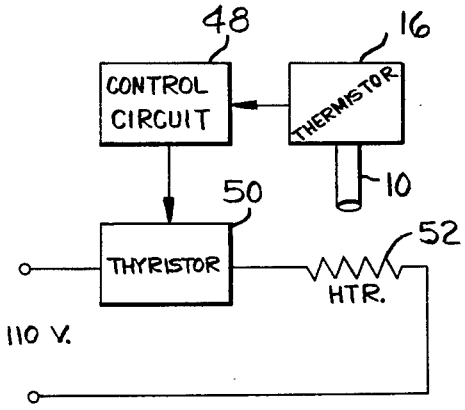
FIG. 5 is a block diagram of the circuitry using the present invention.

This is particularly formed as shown for a purpose to be described. For physically holding the thermistor 16 centrally of the tube, there is provided a pair of separate and complementary half arcuate and electrically conductive clamps 24 and 26 of a suitable metal such as phosphor bronze and these are designed to fit within the paper insulating sleeve 22 as shown in FIG. 2. Clamps 24 and 26 have a spring action so that they are biased outwardly against the sleeve 22 tending to hold the entire assembly snugly within the finger 10. Because of the longitudinal extent of the clamps 24–26 and their outward bias as well as the thinness of electrical insulating sleeve 22, there is good thermal conductivity only through the sleeve into the clamps but no electrical conductivity. Paper sleeve 22 is actually longer than the clamps 24–26 to prevent any contact between the clamps and the tube wall. Additionally, sleeve 22 is suitably formed with bends and folds 28 so that, when assembled, the sleeve electrically insulates the clamps from each other and from finger 10 as shown in FIG. 2. Thus, the sleeve is designed to overlap the arcuate clamps both axially and radially to electrically insulate them from each other and from the finger 10 while permitting good heat conductivity from finger 1 into the clamps by reason of their substantially long axial length and the thinness of sleeve 22. For supporting the thermistor, the clamps are provided with overlapping tabs 30 extending substantially diametrically across the tube as shown in FIG. 2 and the tabs have locating means such as suitable depressions 32 between which thermistor 16 is fixedly supported and retained. With this support, each clamp forms a respective terminal for the thermistor which terminal is continued by an electrical connection to hole 34 using a high melting point solder and a small diameter wire 26 to minimize heat loss through the wire. Thus, depression or recess 32 fixedly retains the thermistor 16, which is soldered to the clamp tabs 30 after all parts are assembled into the end of the finger 10. The respective wires 36 are brought down finger 10 to the housing portion 38 of the probe control and conduct current to the control circuit as shown in FIG. 5 to trigger a thyristor switch in pluses to control the heater. The specific circuitry is the subject of copending application 6D-4963 of common assignment.

Figure 4:
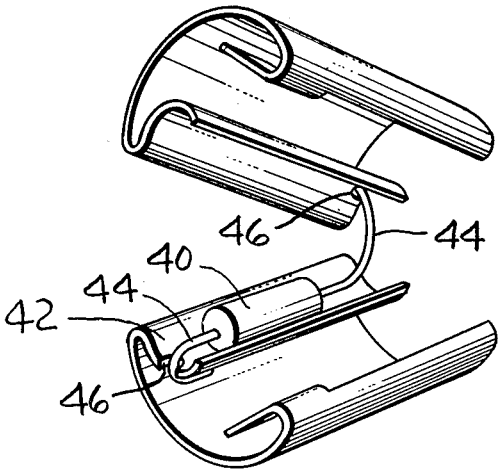
FIG. 4 is an alternate form of supporting clamp.

An alternate clamp is shown in FIG. 4, with its complementary top arcuate clamp raised for clarity. This shows an alternate clamp which may be used with a glass encapsulated thermistor 40 of the type similar in construction to a double heat sink diode. Here the thermistor is placed lengthwise in a groove 42 which is another form of tab 30. The thermistor is retained between grooves 42 of the complementary spring-biased clamps and the leads 44 of the thermistor are bent closely through a notch 46 and soldered inside the groove 42 at notch 46 so that the lead length connecting the thermistor 40 to the clamps is as short as possible. In other words, the leads 44 are bent into a hook shape to pass through notch 46 enough to hold the leads in place for soldering to the clamps. This is done because in this type of thermistor the leads are more effective at transmitting temperatures than are the glass side walls. Also, in this version, the thermistor is closer to the inner surface of finger 10 which puts it closer to the heat source or the cooking surface in a typical heated utensil. In any application, the object is to place the thermistor as close to such heat source as possible so it will assume the same temperature as the skillet bottom very rapidly and then adjust the temperature through the control circuit. Of course, a depression 32 could be used in the modification of FIG. 4 to accommodate a thermistor 16 as described for FIG. 3.

In operation the thin walled stainless tube 10 transmits the heat through the thin insulating sleeve 22 and directly into large high conductivity clamps 24 and 26 where thermistor 16 immediately responds to temperature changes. As shown in FIG. 5, the resistance change of the thermistor 16 is sent into a control circuit 48 which is the subject of said copending application, and which pulses the thyristor 50 to control heater 52 in the skillet.

Thus, the present invention provides a detachable probe which is adaptable to the conventional electric skillet or other utensils and uses a thermistor in adequate thermal contact with the skillet surface by means of the unique mounting arrangement disclosed. The thermistor is electrically isolated from the tube wall by the paper insulator which is a relatively poor conductor of heat but its thinness in contact with the large heat conducting surface of the arcuate clamps serves to make its overall effect on heat transfer negligible thus permitting the insulating sleeve to both electrically insulate and also provide good heat conductivity.

The spring clamps 24, 26 are excellent conductors of heat but have low heat capacity due to their small mass. Thus, temperature changes of the tube are quickly sensed by the thermistor which can relay this information to control circuitry and respond very rapidly, usually between 5 and 10 seconds, to reset the temperature. The mass of all parts is kept small by using thin metal so that less heat is required to cause a change of temperature in the parts and response by the thermistor.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. A detachable probe control for an electrically heated utensil with a hollow tubular finger snugly fitting a matching recess in the utensil for good heat conduction therebetween for control of temperature of said utensil, the improvement comprising:

transducer means supported in said finger and connected to control current to the utensil for governing the heat thereto, said transducer support including electrical insulating sleeve means between the transducer and finger, a pair of separate complementary and electrically conductive members within and biased against said sleeve for good thermal conductivity through the sleeve, said sleeve electrically insulating said members from each other and said finger, said transducer being supported between the complementary members, and means connecting each terminal of the transducer with respective complementary members and said members with said current control for rapid response to temperature changes for accurate heat control of said utensil.

2. Apparatus as described in claim 1 wherein said transducer is a thermistor supported in contact with each complementary member.

3. Apparatus as described in claim 2 wherein said electrical insulating sleeve overlaps the complementary conductive members both axially and radially.

4. A detachable probe control for an electrically heated utensil with a hollow tubular finger snugly fitting a matching recess in the utensil for good heat conduction therebetween for control of temperature of said utensil, the improvement comprising, a thermistor fixedly supported in said finger and connected to control current to said utensil for governing the heat thereto, electrical paper insulating sleeve means between the thermistor and finger and also forming a thermally conductive means therebetween, said thermistor support including a pair of separate complementary half arcuate and electrically conductive clamps oppositely disposed within and biased against said sleeve and finger for good thermal conductivity only through the sleeve, said sleeve insulating said clamps from each other and said finger, said clamps having overlapping tabs within the finger for supporting the thermistor therebetween, whereby each clamp forms a respective terminal for the thermistor, and means connecting each clamp with said current control for rapid response to temperature changes for accurate heat control of said utensil.

5. Apparatus as described in claim 3 wherein said electrical insulating and thermally conductive paper sleeve overlaps the arcuate clamps both axially and radially to electrically insulate from each other and the sleeve.

6. Apparatus as described in claim 5 wherein said tabs extend substantially diametrically across the tube and, locating means on said tabs for retaining the thermistor therebetween.

7. Apparatus as described in claim 6 wherein said tubular finger has a longitudinal slot with a portion of said tube bent out of the peripheral surface thereof for biasing said finger against the walls of said recess for good heat conduction therewith.

* * * * *